US007663449B2

(12) United States Patent
Podell

(10) Patent No.: US 7,663,449 B2
(45) Date of Patent: Feb. 16, 2010

(54) DIVIDER/COMBINER WITH COUPLED SECTION

(75) Inventor: Allen F. Podell, Palo Alto, CA (US)

(73) Assignee: Werlatone, Inc, Brewster, NY (US)

( * ) Notice: Subject to any disclaimer, the term of this patent is extended or adjusted under 35 U.S.C. 154(b) by 353 days.

(21) Appl. No.: 11/458,332

(22) Filed: Jul. 18, 2006

(65) Prior Publication Data

US 2008/0018412 A1 Jan. 24, 2008

(51) Int. Cl.
*H01P 5/12* (2006.01)

(52) U.S. Cl. ..... 333/125; 333/109; 333/116; 333/128; 333/136

(58) Field of Classification Search ..... 333/124, 333/125, 127, 128, 136, 109, 112, 113, 115, 333/116
See application file for complete search history.

(56) References Cited

U.S. PATENT DOCUMENTS

| | | | | |
|---|---|---|---|---|
| 3,091,743 | A | 5/1963 | Wilkinson | |
| 3,516,025 | A | 6/1970 | Podell | |
| 3,529,265 | A | 9/1970 | Podell | |
| 3,761,843 | A * | 9/1973 | Cappucci | 333/112 |
| 3,883,828 | A * | 5/1975 | Cappucci | 333/116 |
| 3,988,705 | A | 10/1976 | Drapac | |
| 4,263,559 | A | 4/1981 | Ho | |
| 4,556,856 | A | 12/1985 | Presser | |
| 4,636,755 | A * | 1/1987 | Gibbs | 333/116 |
| 4,721,929 | A | 1/1988 | Schnetzer | |
| 5,206,611 | A | 4/1993 | Russell | |
| 5,847,625 | A * | 12/1998 | Gillette | 333/128 |
| 6,236,272 | B1 * | 5/2001 | Takei et al. | 330/286 |
| 6,300,848 | B1 | 10/2001 | Miyaji et al. | |
| 6,472,950 | B1 * | 10/2002 | London | 333/125 |
| 6,570,466 | B1 * | 5/2003 | Bahl | 333/128 |
| 6,822,531 | B2 * | 11/2004 | Carlson | 333/104 |
| 6,992,616 | B2 | 1/2006 | Grudkowski et al. | |
| 7,142,052 | B2 * | 11/2006 | Zelley | 330/43 |
| 2004/0263281 | A1 | 12/2004 | Podell | |
| 2005/0122185 | A1 | 6/2005 | Podell | |
| 2005/0122186 | A1 | 6/2005 | Podell | |
| 2005/0146394 | A1 | 7/2005 | Podell | |

(Continued)

OTHER PUBLICATIONS

Search report for the corresponding British application serial No. GB0713768.0 dated Oct. 29, 2007.

(Continued)

*Primary Examiner*—Robert Pascal
*Assistant Examiner*—Kimberly E Glenn
(74) *Attorney, Agent, or Firm*—Kolisch Hartwell, PC

(57) ABSTRACT

A divider may include a stem or first port, and two or more branch ports connected or coupled directly or indirectly to the first port. As mentioned, a divider may include multiple sections. In some examples, a divider may include at least an inductively uncoupled section and an inductively coupled section. An uncoupled section may be characterized by a plurality of associated transmission lines that are substantially inductively uncoupled. On the other hand, a coupled section may include a plurality of associated transmission lines that are substantially inductively coupled. A divider section may include a resistor connected between ends of associated first and second transmission lines in a coupled or uncoupled section. In some examples, one or more uncoupled sections are connected in series to the first port and one or more coupled sections are connected in series between the uncoupled sections and the second and third ports.

16 Claims, 5 Drawing Sheets

U.S. PATENT DOCUMENTS

| | | | |
|---|---|---|---|
| 2005/0156686 | A1 | 7/2005 | Podell |
| 2006/0066418 | A1 | 3/2006 | Podell |

OTHER PUBLICATIONS

Cohen, Seymour B. "A Class of Broadened Three-Port TEM-Mode Hybrids." *IEEE Transactions on Microwave Theory and Techniques*. vol. MTT-16, No. 2. Feb. 1998, pp. 110-116.

Park, Ung-Hee, et al. "A 700- to 2500-MHz Microstrip Balun Using a Wilkinson Divider and 3-dB Quadrature Couplers." *Microwave and Optical Technology Letters*. vol. 47, No. 4. Nov. 20, 2005, pp. 333-335.

United Kingdom Intellectual Property Office, Euros Morris, Examiner, "Examination Search Report under Section 18(3)" for application No. GB0713768.0, date of report Jul. 27, 2009 (2 pages). GB0713768.0 is a counterpart foreign application to this U.S. Appl. No. 11/458,332.

* cited by examiner

DIVIDER/COMBINER WITH COUPLED SECTION

RELATED APPLICATIONS

Background of the Disclosure

The present disclosure relates to dividers/combiners, and in particular to such dividers/combiners formed as a combination of inductively coupled and inductively uncoupled sections.

Dividers are circuits that divide a signal into a plurality of signals. An N-way divider divides a signal into N signals. Conversely, a combiner combines a plurality of signals into a single signal. The same circuit can be a divider or combiner, depending on the direction of current flow, i.e., whether the single port is an input port or an output port. As used herein, then, the use of the term "divider" also means "combiner".

In U.S. Pat. No. 3,091,743, Wilkinson disclosed a power divider in which one end of each of a plurality of branch lines are connected to a common node or port, and the other end of each line is connected to a second node via an interconnecting resistor. In the simple case of two branch lines, the two interconnecting resistors form an isolating interconnecting resistor, that connects the two branch ends of the lines. In his article, *A Class of Broadband Three-Port TEM-Mode Hybrids, IEEE Transactions on Microwave Theory and Techniques*, Vol. MTT-16, No. 2, February 1968, Cohn extended the single section of Wilkinson to multiple cascaded sections formed of pairs of line lengths and interconnecting resistors. The increased number of sections resulted in improved VSWR, isolation and bandwidth.

A pair of spaced-apart conductive lines are inductively coupled when they are spaced closely enough together for energy flowing in one to be induced in the other electromagnetically and/or electrostatically. The amount of energy flowing between the lines is related to the dielectric and magnetic media the conductors are in and the spacing between the lines. Even though electromagnetic fields surrounding the lines are theoretically infinite, lines are often referred to as being closely or tightly coupled, loosely coupled, or uncoupled, based on the relative amount of coupling. The amount of coupling may be defined by a coupling coefficient. However, as a practical measure, two lines may be considered to be inductively coupled when a detectable signal is coupled from one line onto the other. A threshold of coupling may be appropriate to distinguish between coupled and uncoupled lines. In most applications, two lines that have less than 20 dB inductive coupling between them are considered to be uncoupled lines. In some applications, lines that have less than 100 dB are considered to be uncoupled lines.

Couplers are devices formed to take advantage of inductively coupled lines, and may have four ports, one for each end of two inductively coupled lines. A main line has an input connected directly or indirectly to an input port. The other end is connected to the direct port. The other or auxiliary line extends between a coupled port and an isolated port. One or more of the ports may be terminated to form a coupler device having fewer than four ports. Some couplers are described as having two input ports, a sum port that has a signal that is the sum of signals received at the input ports, and a difference port that has a signal that is the difference of the signals received at the input ports. A coupler may be reversed, in which case the isolated port becomes the input port and the input port becomes the isolated port. Correspondingly, the coupled port and direct port then have reversed designations.

Directional couplers are four-port networks that may be simultaneously impedance matched at all ports. Power may flow from one or the other input port to the pair of output ports, and if the output ports are properly terminated, the ports of the input pair are isolated. A hybrid coupler is generally assumed to divide its output power equally between the two outputs, whereas a directional coupler, as a more general term, may have unequal outputs. Often, the coupler has very weak coupling to the coupled output, which minimizes the insertion loss from the input to the main output. One measure of the quality of a directional coupler is its directivity, the ratio of the desired coupled output to the isolated port output.

Coupled adjacent parallel transmission lines couple both electrically and magnetically. The coupling is inherently proportional to frequency, and the directivity can be high if the magnetic and electric couplings are equal. Longer coupling regions increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

BRIEF SUMMARY OF THE DISCLOSURE

A divider may include a stem or first port, and two or more branch ports connected or coupled directly or indirectly to the first port. As mentioned, a divider may include multiple sections. In some examples, a divider may include at least an inductively uncoupled section and an inductively coupled section. An uncoupled section may be characterized by a plurality of associated transmission lines that are substantially inductively uncoupled. On the other hand, a coupled section may include a plurality of associated transmission lines that are substantially inductively coupled.

A coupled or uncoupled section may include a resistor connected between ends of the associated first and second transmission lines. In some examples, one or more uncoupled sections are connected in series to the first port and one or more coupled sections are connected in series between the uncoupled sections and the second and third ports.

Also, in some examples, a divider may include a plurality of divider sections coupling a first port to second and third ports. Each divider section may include first and second associated transmission lines, with each transmission line having first and second ends. The divider sections may include at least one coupled section and at least one uncoupled section. The first transmission lines of the plurality of divider sections may be connected in series with a first end of one of the first transmission lines directly connected to the first port and the second end of another of the first transmission lines directly connected to the second port. The second transmission lines of the divider sections also may be connected in series, with an end of the series directly connected to the third port. At least one of the divider sections further may include a resistor connected between the second ends of the first and second transmission lines of the one divider section. The first and second associated transmission lines of each uncoupled section may be substantially inductively mutually uncoupled, and the first and second transmission lines of each coupled section may be substantially inductively mutually coupled.

DETAILED DESCRIPTION OF VARIOUS EXAMPLES

Figure 1:
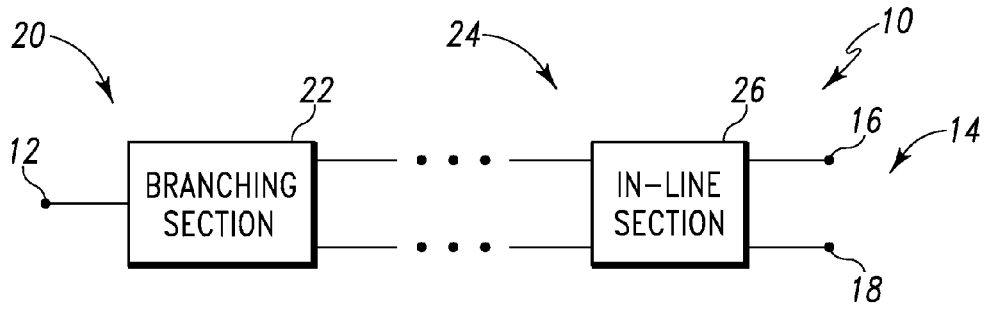
FIG. 1 is a general block diagram of at least a two-section divider including a branching section and an in-line section.

This description is illustrative and directed to exemplary apparatus and/or methods that may include one or more inventions. The appended claims define specific inventions included in one or more of the disclosed examples. Claims in other applications based on this application may claim other inventions. No single feature or element, or combination thereof, is essential to all possible combinations that may now or later be claimed. All inventions may not be included in every example. Many variations may be made to the disclosed embodiments. Such variations may be directed to different combinations or directed to the same combinations, and may be different, broader, narrower or equal in scope.

Where "a" or "a first" element or the equivalent thereof is recited, such usage includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically indicated.

As used in this document, two lines are inductively coupled when a detectable signal is inductively coupled from one line onto the other. The amount of coupling may be selected for a particular application. The term divider also means combiner, since the same circuit may be used for either application depending on which ports a signal is or signals are applied. Further, circuit elements are considered to be directly connected when there are no intervening elements between them. Correspondingly, circuit elements are considered to be coupled together and indirectly connected, when there are intervening elements between them.

A divider may include first, second and third ports, and a plurality of divider sections coupling the first port to the second and third ports including at least one coupled section and at least one uncoupled section, each divider section including associated first and second transmission lines, each transmission line having first and second ends, the first transmission lines of the plurality of divider sections being connected in series with a first end of one of the first transmission lines directly connected to the first port and the second end of another of the first transmission lines directly connected to the second port, and the second transmission lines of the divider sections being connected in series, with the second transmission line, associated with the other first transmission line, having a second end directly connected to the third port, at least one of the divider sections further including a first resistor connected between the second ends of the first and second transmission lines of the one divider section, the first and second associated transmission lines of each uncoupled section being substantially inductively mutually uncoupled, and the first and second transmission lines of each coupled section being substantially inductively mutually coupled.

Referring initially to FIGS. 1-5, such a divider is shown generally at 10. Divider 10 may include a single stem or first port 12 and two or more branch ports 14, such as a second port 16 and a third port 18. First port 12 may be coupled to branch ports 14 by a plurality of divider sections 20. Divider sections 20 may include a branching section 22 and one or more in-line sections 24, such as an in-line section 26.

The divider sections 20 each may include associated first and second transmission lines. The lines may be inductively coupled or uncoupled, and may include an interconnecting resistor between the associated lines. Divider sections in which the associated transmission lines are substantially mutually inductively uncoupled are referred to as uncoupled sections, or simply uncoupled sections. Similarly, divider sections in which the associated transmission lines are substantially mutually inductively coupled are referred to as coupled sections, or simply coupled sections. The electrical lengths L of the transmission lines in the various examples are typically 90 degrees or a quarter of a wavelength ($\lambda/4$) at a design frequency, although the lengths may be different in specific applications. Each transmission line also has an impedance, and in the case of coupled transmission lines, the lines will have an even-mode impedance and an odd-mode impedance.

Figure 2:
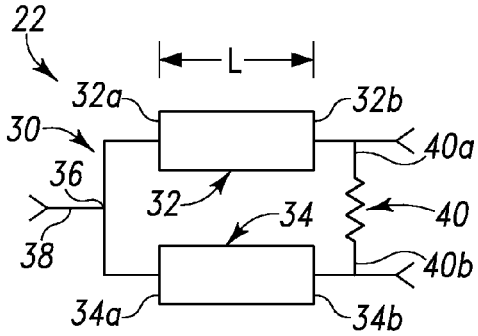
FIG. 2 is a diagram of an example of an uncoupled branching section that may be used in the divider of FIG. 1.

FIGS. 2-5 illustrate examples of divider sections 20, and in particular, a branching section 22 and one or more in-line sections 24. FIG. 2 illustrates an uncoupled branching section 30 having substantially inductively uncoupled and associated first and second transmission lines 32, 34. These transmission lines each have respective first and second ends 32*a*, 32*b* and 34*a* and 34*b*. The first ends 32*a*, 34*a* of the transmission lines may be connected at a connection 36 to a single conductor 38. Conductor 38 then is connected to or forms the first port 12 of the divider. An interconnecting resistor 40 may be connected between transmission lines 32, 34. In particular, a first end 40*a* of the resistor may be connected to transmission line end 32*b*, and a second end 40*b* of the resistor may be connected to transmission line end 34*b*. The second ends 32*b*, 34*b* of these transmission lines may also be connected to corresponding lines of an adjacent in-line section.

Figure 3:
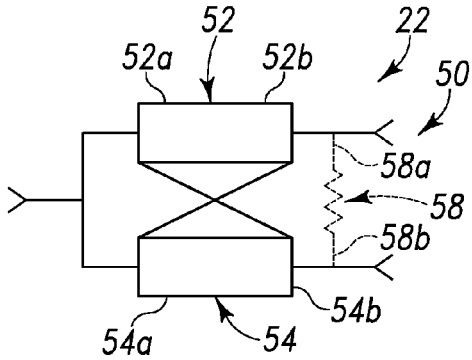
FIG. 3 is a diagram of an example of a coupled branching section that may be used in the divider of FIG. 1.

FIG. 3 illustrates a coupled branching section 50 having substantially inductively coupled and associated first and second transmission lines 52, 54. These transmission lines have respective first and second ends 52*a*, 52*b* and 54*a*, 54*b*. The first ends 52*a* and 54*a* of respective transmission lines 52 and 54 may be connected at a connection 56 to a single conductor 57. Conductor 57 then may be connected to the first port 12 of the divider, or the transmission line end may serve as the first port. The second ends 52*b*, 54*b* of these transmission lines may be connected to corresponding lines of an adjacent in-line section. Optionally, an interconnecting resistor 58 may be connected between transmission lines 52, 54. In particular, a first end 58*a* of resistor 58 may be connected to transmission line end 52*b*, and a second end 58*b* of the interconnecting resistor may be connected to transmission line end 54*b*.

Figure 4:
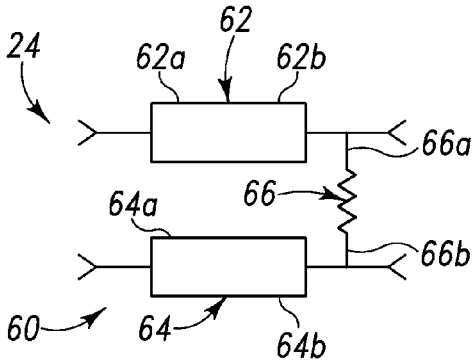
FIG. 4 is a diagram of an example of an uncoupled in-line section that may be used in the divider of FIG. 1.

FIG. 4 illustrates an uncoupled in-line section 60 having substantially inductively uncoupled and associated first and second transmission lines 62, 64. These transmission lines have respective first and second ends 62*a*, 62*b* and 64*a* and

64*b*. The first ends 62*a*, 64*a* of these transmission lines may be connected to corresponding lines of an adjacent branch or in-line section. The second ends 62*b*, 64*b* of these transmission lines may be connected to corresponding lines of an adjacent in-line section or, like section 26 in FIG. 1, to the second and third ports. An interconnecting resistor 66 may be connected between the respective ends of transmission lines 62, 64. In particular, a first end 66*a* of the resistor may be connected to transmission line end 62*b*, and a second end 66*b* of the resistor may be connected to transmission line 64*b*.

Figure 5:
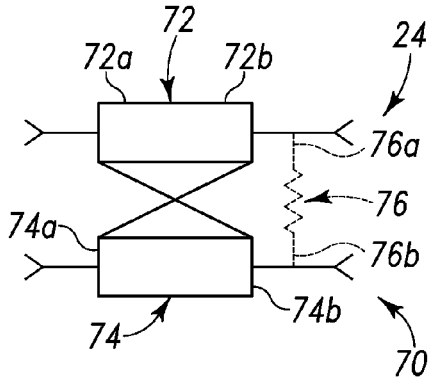
FIG. 5 is a diagram of an example of a coupled in-line section that may be used in the divider of FIG. 1.

FIG. 5 illustrates a coupled in-line section 70 having substantially inductively coupled and associated first and second transmission lines 72, 74. These transmission lines have respective first and second ends 72*a*, 72*b* and 74*a* and 74*b*. The first ends 72*a*, 74*a* of these transmission lines may be connected to corresponding lines of an adjacent branch or in-line section. The second ends 72*b*, 74*b* of these transmission lines may be connected to corresponding lines of an adjacent in-line section or, like section 26 in FIG. 1, to the second and third ports. Optionally, an interconnecting resistor 76 may be connected between the respective ends of transmission lines 72, 74. In particular, a first end 76*a* of resistor 76 may be connected to transmission line end 72*b*, and a second end 76*b* of the interconnecting resistor may be connected to transmission line end 74*b*.

Figure 6:
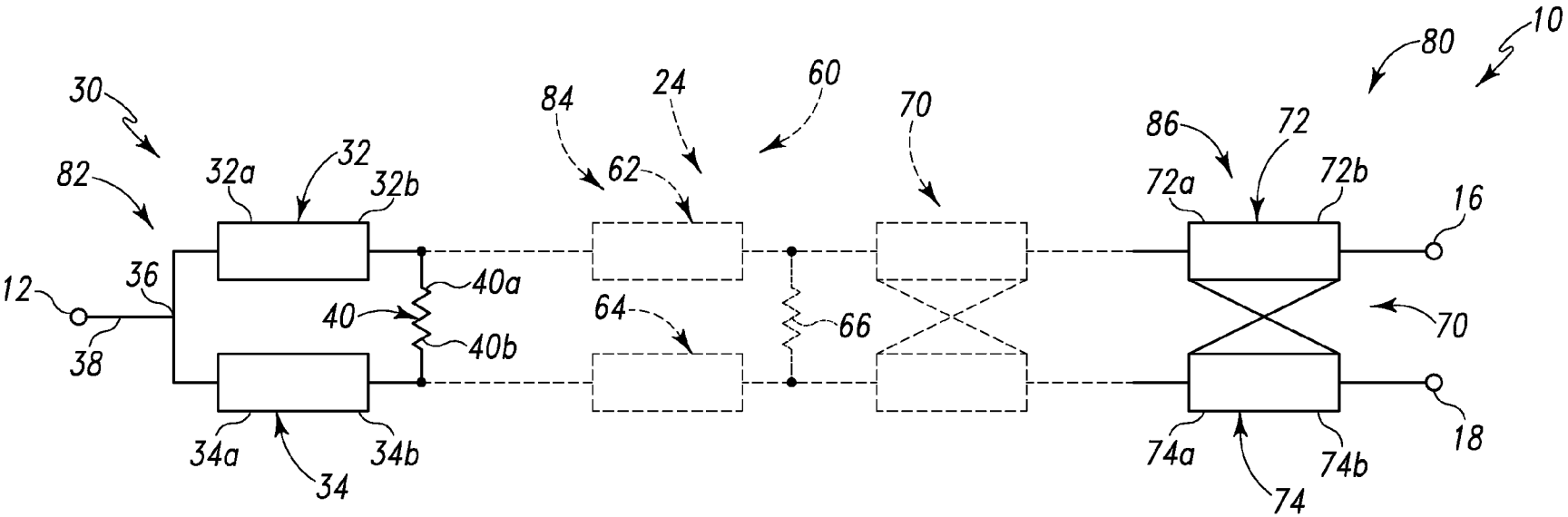
FIG. 6 is a diagram of a multiple-section divider including an uncoupled branching section and one or more in-line sections, including at least one coupled section.

FIG. 6 illustrates a general diagram of an exemplary multiple-section divider 80 including an uncoupled branching section 82 and one or more in-line sections 84, including end coupled in-line section 86. Divider 80 is a specific example of a divider 10. Branching section 30 is the same as section 30 depicted in FIG. 2, having substantially inductively uncoupled and associated first and second transmission lines 32, 34. These transmission lines each have respective first and second ends 32*a*, 32*b* and 34*a*, 34*b*. The first ends 32*a*, 34*a* of the transmission lines are connected at a junction or connection 36 to a single conductor 38. Conductor 38 then is connected to or forms the first port 12 of the divider. An interconnecting resistor 40 is connected between transmission lines 32, 34. In particular, a first end 40*a* of the resistor is connected to transmission line end 32*b*, and a second end 40*b* of the resistor is connected to transmission line end 34*b*. The second ends 32*b*, 34*b* of these transmission lines are connected to corresponding lines of an adjacent in-line section, such as end section 86.

In this example, end section 86 is a coupled in-line section 70, as is shown in FIG. 5. Accordingly, section 86 includes substantially inductively coupled and associated first and second transmission lines 72, 74. These transmission lines have respective first and second ends 72*a*, 72*b* and 74*a*, 74*b*. The first ends 72*a*, 74*a* of these transmission lines are connected to corresponding lines of an adjacent branch or in-line section. The second ends 72*b*, 74*b* of these transmission lines are connected to the second and third ports 16, 18. No interconnecting resistor is connected between transmission lines 72, 74.

Further, one or more in-line sections 84 may be connected between branching section 82 and end in-line section 86. For example, there may be a plurality of uncoupled sections 60 or a plurality of coupled sections 70, or both. In one example, then, there may be a plurality of uncoupled sections 60 connected in series with branching section 82. There also may be a plurality of coupled sections 70 connected in series between end section 86 and the uncoupled sections 60. The uncoupled sections may each have an interconnecting resistor 66, whereas none of the coupled sections may have an interconnecting resistor 76.

Figure 7:
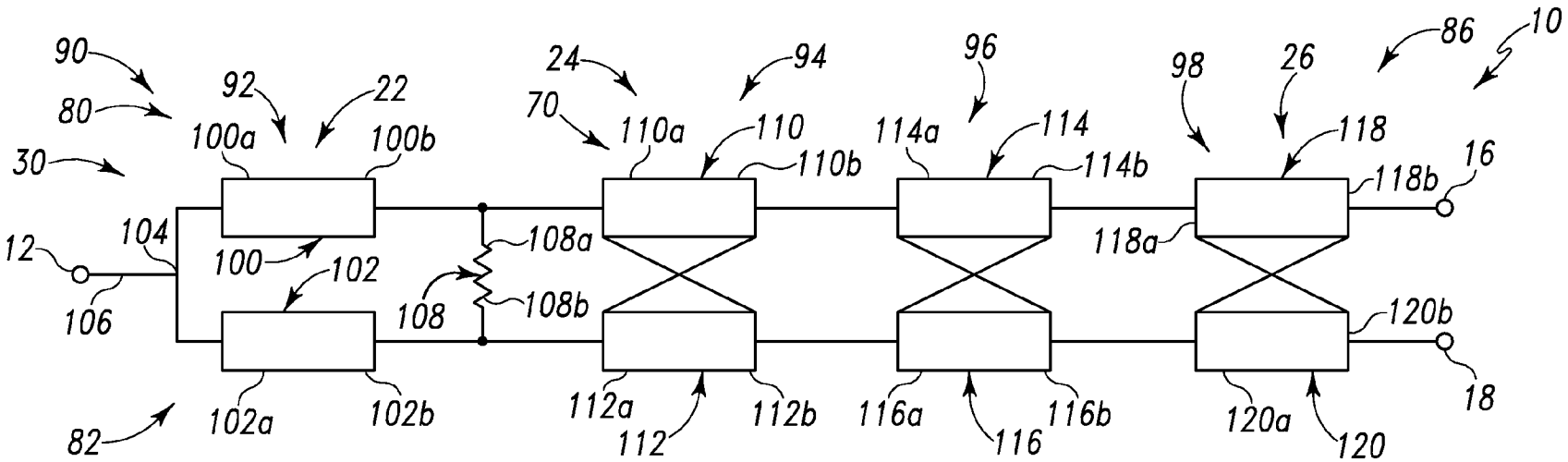
FIG. 7 is a diagram of a four-section divider having an uncoupled branching section and three coupled in-line sections.

FIG. 7 is a diagram of a four-section divider 90 having an uncoupled branching section 92 and three coupled in-line sections 94, 96, 98 connecting a first port 12 to branch ports 16 and 18. Divider 90 is a specific example of a divider 10 and a divider 80. Branching section 92 corresponds to branching section 30 shown in FIG. 2, and includes substantially inductively uncoupled and associated first and second transmission lines 100, 102. These transmission lines each have respective first and second ends 100*a*, 100*b* and 102*a*,102*b*. The first ends 100*a*, 102*a* of the transmission lines are connected at a junction or connection 104 to a single conductor 106. Conductor 106 then is connected to or forms the first port 12 of the divider. An interconnecting resistor 108 is connected between transmission lines 100, 102. In particular, a first end 108*a* of the resistor is connected to transmission line end 100*b*, and a second end 108*b* of the resistor is connected to transmission line end 102*b*. The second ends 100*b*, 102*b* of these transmission lines are connected to corresponding lines of adjacent in-line section 94.

In-line sections 94, 96, 98 are examples of in-line sections 24 shown in FIG. 1 and in-line section 70 shown in FIG. 5. Each of sections 94, 96, 98 includes substantially coupled and associated transmission lines, and no interconnecting resistors. Specifically, section 94 includes substantially inductively coupled and associated first and second transmission lines 110, 112. These transmission lines have respective first and second ends 110*a*, 110*b* and 112*a*, 112*b*. The first ends 110*a*, 112*a* of these transmission lines are connected to respective transmission line ends 100*b*, 102*b* and resistor ends 108*a*, 108*b* of adjacent branching section 92.

Section 96 includes substantially inductively coupled and associated first and second transmission lines 114, 116. These transmission lines have respective first and second ends 114*a*, 114*b* and 116*a* and 116*b*. The first ends 114*a*, 116*a* of these transmission lines are connected to respective transmission line ends 110*b*, 112*b* of adjacent branching section 94.

End section 98 includes substantially inductively coupled and associated first and second transmission lines 118, 120. These transmission lines have respective first and second ends 118*a*, 118*b* and 120*a*, 120*b*. The first ends 118*a*, 120*a* of these transmission lines are connected to respective transmission line ends 114*b*, 116*b* of adjacent branching section 96. Transmission line ends 118*b*, 120*b* of these transmission lines are connected to branch ports 16, 18.

First transmission lines 100, 110, 114, 118 are connected in series between first port 12 and branch port 16. Similarly, second transmission lines 102, 112, 116, 120 are connected in series between first port 12 and branch port 18. Even though there are multiple divider sections 20 in divider 90, there is an isolation resistor only on the branch ends of the transmission lines of uncoupled branching section 92. The remaining coupled sections 94, 96, 98 are configured to have odd mode and even mode impedances that provide the appropriate impedance between the associated first and second transmission lines.

Following are design values for the components of divider 90 for impedances of 50 ohms on ports 12, 16 and 18 and a design frequency of 0.5 GHz.

| Each of transmission lines 100 and 102: | |
|---|---|
| Impedance: | 87.16 ohms |
| Electrical length: | 87.41 degrees |
| Resistor 108: | 52.6 ohms |

-continued

| | Coupled In-line sections: | | |
|---|---|---|---|
| | 94 | 96 | 98 |
| Even-mode impedance (ohms): | 76.35 | 66.00 | 57.83 |
| Odd-mode impedance (ohms): | 27.00 | 36.06 | 44.79 |
| Electrical length (degrees): | 90 | 90 | 90 |

It is seen that the odd-mode impedances of the coupled sections increase progressively in value from the uncoupled section to the second and third ports. Further, the even-mode impedances of the coupled sections decrease progressively in value from the uncoupled section to the second and third ports. The resistor and the transmission lines are configured to provide 3 dB output signals on the second and third ports for a given input signal applied to the first port over a bandwidth of more than 5:1. The resistor and the transmission lines are configured to have a pass band above 100 MHz. Additionally, the first resistor has a nominal impedance of less than 1.2 (52.6 ohms divided by 50 ohms equals 1.05) for a nominal impedance of 1.0 on the input port.

Figure 8:
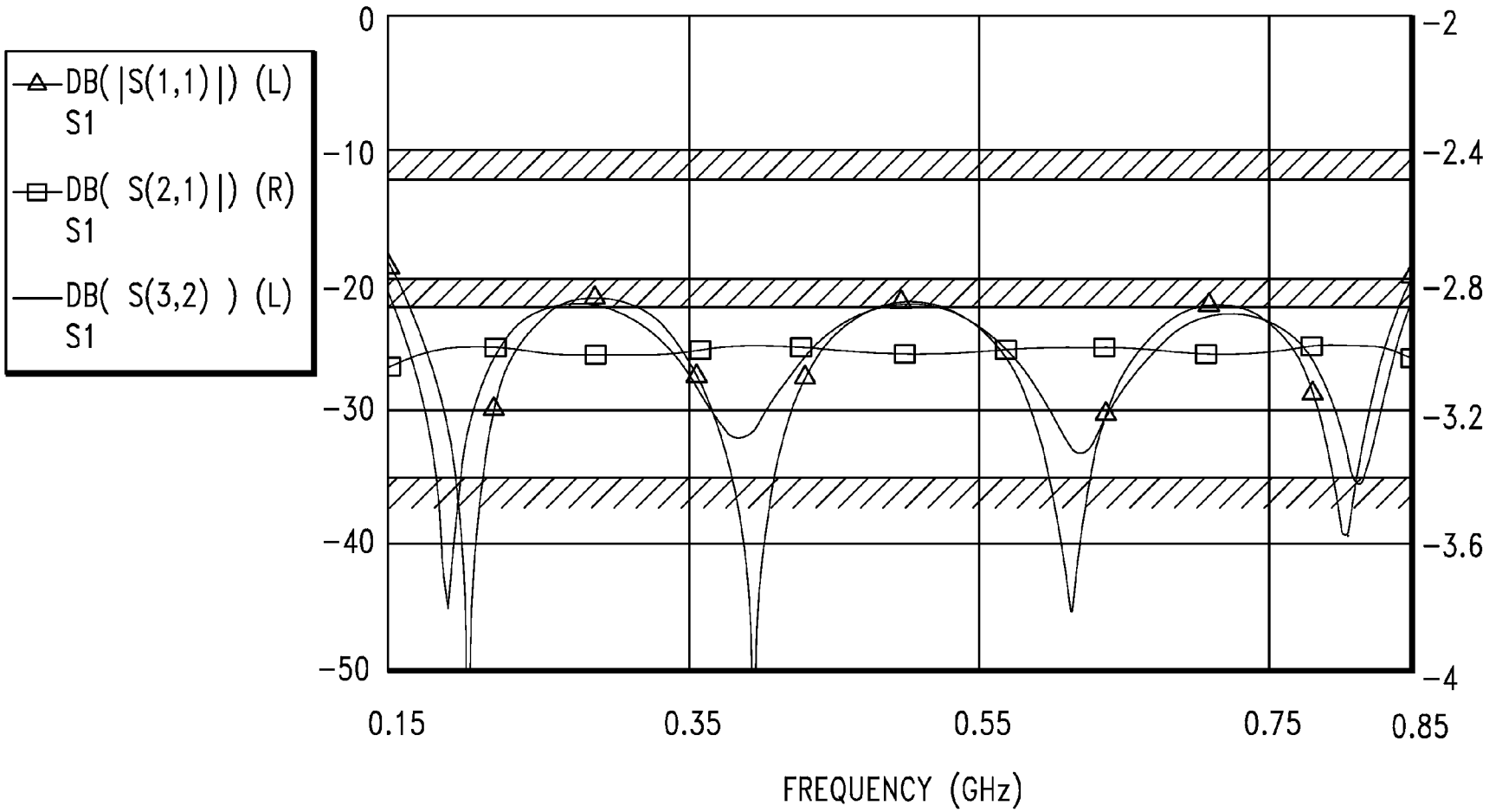
FIG. 8 is a chart illustrating a simulated performance of one embodiment of the divider of FIG. 7.

FIG. 8 illustrates the simulated performance of divider 90. Ports 12, 16 and 18 are identified as ports 1, 2 and 3, respectively. It is seen that the gain ($S_{21}$) is about −3 dB over a pass band having the frequency range of 0.15 GHz to 0.85 GHz. The reflection coefficient or return loss at port 12 ($S_{11}$) and the isolation ($S_{32}$) between ports 16 and 18 are less than −20 dB over most of this 1:5.7 bandwidth.

Divider 90 may be considered to be a collapsed Cohn divider. That is, the first or branching section is similar to a three-port Wilkinson divider. The three in-line sections are coupled sections rather than uncoupled sections with interconnecting resistors, as disclosed by Cohn. By coupling the associated transmission lines of each of the coupled sections 94, 96, 98, the positions of the resistors can in effect be moved to be in parallel at transmission line ends 100*b*, 102*b*. Resistor 108 is then, in effect, the sum of parallel resistances attributable to the three coupled sections. The resulting relatively low value for the single interconnecting resistor makes it practical to build, particularly in high power applications where there is a tradeoff between thermal performance and high frequency performance.

This approach can be applied to more than two-branch port dividers. For example, a secondary branching section could be applied to the two branch lines of a first branching section, and one or more coupled sections can then be connected to each of the secondary branching sections, similar to divider 90. In an N-way divider having a single N-way branching section, the in-line sections then provide coupling between the associated and coupled N-transmission lines in each section.

Figure 9:
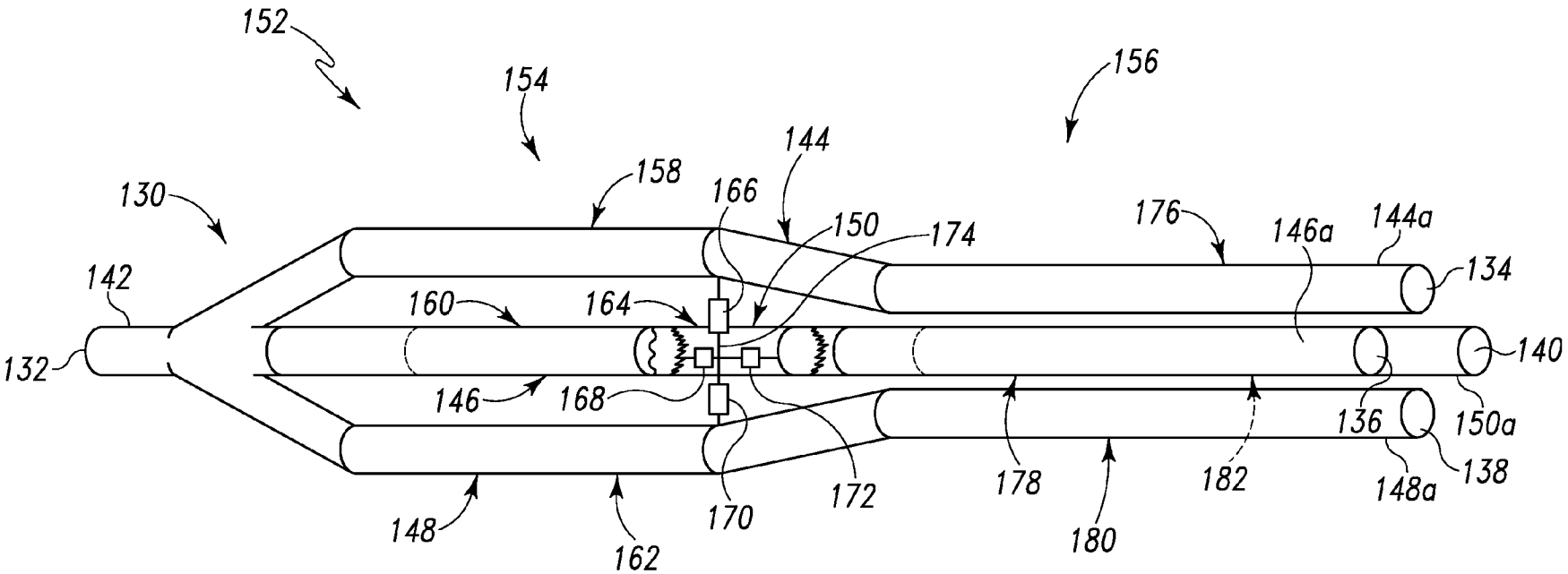
FIG. 9 is a simplified side view of the conductors of an exemplary two-section, four-conductor divider.

This is illustrated by the simplified three-dimensional illustration of a two-section, four-way divider 130 shown in FIG. 9. The figure is a partially fragmented, side view of the conductors and resistors of divider 130. This divider includes a first or primary port 132 and four branch ports 134, 136, 138, 140. Primary port 132 is part of an end conductor 142, which is connected to four branch conductors 144, 146, 148, 150. These branch conductors terminate at branch ends 144*a*, 146*a*, 148*a*, 150*a*, which ends may be considered to be respective branch ports 134, 136, 138, 140. The conductors are supported in or relative to a suitable dielectric material, all or a portion of which may be air.

Divider 130 includes a plurality of divider sections 152, similar to divider 10, including a first branching section 154 and a second in-line section 156. First section 154 corresponds with branching section 30 depicted in FIG. 2, and in-line section 156 corresponds with in-line section 70 depicted in FIG. 5. Section 154 includes associated and substantially mutually uncoupled transmission lines 158, 160, 162, 164 formed by respective conductors 144, 146, 148, 150. First, second, third and fourth interconnecting resistors 166, 168, 170, 172 each connect a respective end of a transmission line to a common node 174, as shown.

Section 156 includes associated and substantially mutually inductively coupled transmission lines 176, 178, 180, 182. In section 156, conductors 144, 146, 148, 150 are disposed sufficiently close together, based on the dielectric medium separating them, to provide inductive coupling between them. The electrical lengths of these conductors may be about 90 degrees or a quarter of a design wavelength, unless additional impedances are added between the conductors, and between the conductors and ground.

It is seen then, that a divider may include a primary port and N branch ports, where N is an integer greater than 1, a branching section and at least one coupled in-line section. The branching section may include N first resistors having first and second ends, the first ends of the first resistors being conductively connected together, and N branch transmission lines each having a first end conductively connected to the primary port and a second end conductively connected to the second end of a respective one of the first resistors. The branch transmission lines may be substantially mutually inductively uncoupled. Each first coupled section may include N associated and mutually inductively coupled transmission lines, each coupled transmission line having a first end conductively coupled to the first end of a respective one of the first resistors and a second end conductively coupled to a respective one of the branch ports.

Several in-line sections may be connected serially or in parallel to couple a signal or signals between the primary port and the branch ports. Divider 130 is an example having one in-line section and four transmission lines in each section. Other examples may have more or fewer transmission lines and more in-line sections. Accordingly, as has been mentioned, while examples of multi-port dividers have been particularly shown and described, many variations may be made therein.

INDUSTRIAL APPLICABILITY

The methods and apparatus described in the present disclosure are applicable to industries and systems using high frequency signals, such as used in telecommunications applications including audio, video and data communications, and broadcasting systems. Microwave power dividers are useful in a wide variety of instrumentation and system applications, such as feeding signals to multiple antennas. Power dividers can also be used to combine microwave signals by applying the signals to be combined to what would normally be considered the outputs of the divider. Combining signals in this manner may provide high output power from a plurality of semiconductor signal devices, such as amplifiers.

What is claimed is:

1. A divider comprising:

first, second and third ports; and a plurality of divider sections coupling the first port to the second and third ports including at least a first coupled divider section and at least a first uncoupled divider section, each of the plurality of divider sections including associated first and second transmission lines, the first and second transmission lines having first and second ends, the first transmission lines of the plurality of divider sections being conductively connected in series with the first end of the first transmission line of the first uncoupled divider section being directly connected to the first port and the second end of the first transmission line of the first coupled divider section being directly connected to the second port, and the second transmission lines of the plurality of divider sections being connected in series, with the second end of the second transmission line of the first coupled divider section being directly connected to the third port, at least one of the plurality of divider sections further including at least a first resistor connected between the second ends of the first and second transmission lines of the at least one of the plurality of divider sections, and the associated first and second transmission lines of the first uncoupled divider section being substantially inductively mutually uncoupled, and the associated first and second transmission lines of the first coupled divider section being substantially inductively mutually coupled.

2. The divider of claim 1, wherein a plurality of the divider sections are uncoupled divider sections.

3. The divider of claim 1, wherein a plurality of the divider sections are coupled divider sections.

4. The divider of claim 3, wherein the first end of the second transmission line of the first uncoupled divider section is directly connected to the first port.

5. The divider of claim 1, wherein the plurality of divider sections includes a plurality of coupled divider sections including the first coupled divider section.

6. The divider of claim 1, wherein the resistor is directly connected between the second ends of the associated first and second transmission lines of the first uncoupled divider section.

7. The divider of claim 6, wherein the first uncoupled divider section is the only uncoupled divider section.

8. The divider of claim 1, wherein the first resistor and the first and second transmission lines have respective impedances that are configured to provide substantially equal output signals on the second and third ports for a given input signal having a given frequency input on the first port.

9. The divider of claim 8, wherein the plurality of divider sections include a plurality of coupled divider sections, including the first coupled divider section, coupled in cascade between the first uncoupled divider section and the second and third ports, each of the plurality of coupled divider sections has an odd-mode impedance, and the odd-mode impedances of the plurality of coupled divider sections increase progressively in value from the first uncoupled divider section to the second and third ports.

10. The divider of claim 9, wherein each of the plurality of coupled divider sections also has an even-mode impedance, and the even-mode impedances of the plurality of coupled divider sections decrease progressively in value from the first uncoupled divider section to the second and third ports.

11. The divider of claim 9, wherein the at least the first resistor and the transmission lines are configured to provide 3 dB output signals on the second and third ports for the given input signal applied to the first port over a bandwidth of more than 5:1.

12. The divider of claim 11, wherein the at least the first resistor and the transmission lines are configured to have a pass band above 100 MHz.

13. The divider of claim 8, wherein the first resistor has a nominal impedance of less than 1.2 for an impedance of 1.0 on the input port.

14. The divider of claim 1, in which at least the second ends of the first and second transmission lines of at least the first coupled divider section are directly unconnected.

15. A divider comprising:

a primary port;

N branch ports, where N is an integer greater than 1;

a branching divider section including

N first resistors having first and second ends, the first ends of the first resistors being conductively connected together; and N branch transmission lines having respective first and second ends, the first ends of the branch transmission lines being collectively directly connected to the primary port and the second end of each of the branch transmission lines being conductively connected to the second end of a respective one of the first resistors, the branch transmission lines being substantially mutually inductively uncoupled; and at least a first coupled divider section including N associated and mutually inductively coupled transmission lines, each of the N mutually inductively coupled transmission lines extending in series with a respective one of the N branch transmission lines between the primary port and a respective one of the branch ports, and having a first end conductively coupled to the first end of a respective one of the first resistors and a second end conductively coupled to the respective one of the branch ports.

16. The divider of claim 15, in which N is greater than 2.

* * * * *

UNITED STATES PATENT AND TRADEMARK OFFICE

CERTIFICATE OF CORRECTION

PATENT NO. : 7,663,449 B2
APPLICATION NO. : 11/458332
DATED : February 16, 2010
INVENTOR(S) : Allen F. Podell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 566 days.

Signed and Sealed this

Thirtieth Day of November, 2010

David J. Kappos

David J. Kappos
*Director of the United States Patent and Trademark Office*